US006457930B2

(12) United States Patent
Hermsen et al.

(10) Patent No.: US 6,457,930 B2
(45) Date of Patent: Oct. 1, 2002

(54) DEVICE AND PROCEDURE FOR THE SLITTING OPEN OF SACKS

(75) Inventors: Manfred Hermsen, Hellwege; Ewald Marnette, Ritterhude; Heinrich Klöckner, Gnarrenburg, all of (DE)

(73) Assignee: CR-3 Kaffeeveredelung M. Hermsen GmbH & Co., Bremen (DE)

( * ) Notice: Subject to any disclaimer, the term of this patent is extended or adjusted under 35 U.S.C. 154(b) by 0 days.

(21) Appl. No.: 09/798,440

(22) Filed: Mar. 2, 2001

Related U.S. Application Data

(63) Continuation-in-part of application No. 09/264,798, filed on Mar. 9, 1999, now abandoned, which is a continuation-in-part of application No. 08/703,668, filed on Aug. 27, 1996, now abandoned, which is a continuation of application No. PCT/EP95/00698, filed on Feb. 27, 1998.

(30) Foreign Application Priority Data

Feb. 28, 1994 (DE) ..... 94 03 363 U

(51) Int. Cl.[7] ..... B65B 69/00

(52) U.S. Cl. ..... 414/412; 241/101.74; 241/101.76; 414/539

(58) Field of Search ..... 414/412, 507, 414/539; 241/101.71, 101.74, 101.75, 101.76, 109, 243, 280, 285.2; 83/928

(56) References Cited

U.S. PATENT DOCUMENTS

| | | | | | |
|---|---|---|---|---|---|
| 2,410,953 | A | * | 11/1946 | Mesenger et al. | |
| 3,386,602 | A | | 6/1968 | Kanarek | 214/305 |
| 3,509,924 | A | * | 5/1970 | Newhouse, Jr. | |
| 3,596,842 | A | | 8/1971 | Barber et al. | 241/222 |
| 3,999,674 | A | * | 12/1976 | Meitl | 241/101.76 X |
| 4,069,929 | A | * | 1/1978 | Harker | |
| 4,543,029 | A | * | 9/1985 | Grün et al. | 414/412 |
| 4,612,779 | A | * | 9/1986 | Hatton | 241/101.76 X |
| 4,646,757 | A | * | 3/1987 | Schmitt et al. | 241/101.71 X |
| 4,723,717 | A | | 2/1988 | Fagnant | 241/222 |
| 4,917,310 | A | * | 4/1990 | Carrera | 241/190 X |
| 4,986,716 | A | * | 1/1991 | Winter | 414/408 X |
| 5,002,451 | A | * | 3/1991 | Hale et al. | 414/412 |
| 5,007,787 | A | * | 4/1991 | Schnader | 414/412 |
| 5,155,975 | A | * | 10/1992 | Knowler | 241/243 X |
| 5,503,339 | A | * | 4/1996 | Doppstadt | 241/243 X |
| 5,567,106 | A | * | 10/1996 | Gassner | 414/412 |
| 5,713,525 | A | * | 2/1998 | Morey | |
| 6,089,814 | A | * | 7/2000 | Bayer | 414/412 |

FOREIGN PATENT DOCUMENTS

| | | | | |
|---|---|---|---|---|
| DE | 2900242 | * | 7/1979 | 414/412 |
| DE | G 93 02 499.1 | | 6/1993 | |
| DE | G 94 03 363.3 | | 6/1994 | |
| DE | 4338204 | * | 5/1995 | |
| EP | 172976 | * | 3/1986 | 414/412 |
| WO | 95/23092 | | 8/1995 | |

OTHER PUBLICATIONS

U.S. patent application Ser. No. 09/264,798, Hermsen et al., filed Mar. 9, 1999.

U.S. patent application Ser. No. 08/703,668, Hermsen et al., filed Aug. 27, 1996.

* cited by examiner

*Primary Examiner*—James W. Keenan
(74) *Attorney, Agent, or Firm*—Vidas, Arrett & Steinkraus

(57) ABSTRACT

A device (10) for slitting sacks through the use of rotating blades or disks (12) comprises a housing (14) which accommodates at least one mechanically drivable shaft (16) on which blades or disks are mounted. The housing (14) has an inlet opening (18), through which the filled sacks are fed mechanically or under the action of gravity, and an outlet opening (20), through which the slit sacks and the material released from the sacks can be carried away under the action of gravity. Furthermore, a movable restraining apparatus (24) is driven by a drive assembly from a first position in which the restraining apparatus is in a covered state and prevents sacks from reaching the at least one cutting member to a second position in which the restaining apparatus is in a released state and allows sacks to reach the at least one cutting member.

25 Claims, 15 Drawing Sheets

DEVICE AND PROCEDURE FOR THE SLITTING OPEN OF SACKS

This application is a continuation-in-part of U.S. application Ser. No. 09/264,798 filed Mar. 9, 1999 now abandoned which was a continuation-in-part of U.S. application Ser. No. 08/703,668 filed Aug. 27, 1996 now abandoned, which was the national stage application of patent publication No. WO 95/23092, application Ser. No. PCT/EP95/00698 filed Feb. 27, 1995, designatng the United States of America, the contents of all of which are incorporated herein by reference in their entirety.

FIELD OF THE INVENTION

The invention concerns a device as well as a procedure for slitting open sacks, especially coffee sacks by means of rotating cutting members like blades or discs.

BACKGROUND OF THE INVENTION

Devices and procedures of this kind are well known. With these devices and procedures, a transport unit of sacks, for instance coffee sacks, frequently the cargo of a transoceanic container, is unloaded on a chute or slide, which tapers conically or in funnel shape, in order to make possible an isolation of the unloaded sacks. Isolated in this way, the sacks are then carried by means of conveyor belts and similar conveyances to a device for slitting open the sacks. The device for this consists of a shaft equipped with blades or disks, which is mechanically driven and which slits open the sacks lengthwise. The pile, consisting in this example of coffee sacks and coffee beans, is conveyed to a separation machine, which separates out the slit-open coffee sacks in a manner well-known. The separated coffee sacks can then be disposed of or recycled in the usual ways.

This installation and its associated procedures are very costly and cannot be operated without attendant personnel. So, for example, it is unavoidable that at the funnel-formed end of the chute, an attendant must be posted, who with muscle-power removes the sacks that inevitably again and again become wedged together. It is also possible that, before the device for slitting open, a blockage of this sort arises, that the sacks become wedged together or even fall off the conveyor belt. Here too an attendant has to clear away these obstructions by employing muscle power. Furthermore, because of its many moving parts, a device of this kind is liable to breakdowns and has a high maintenance cost.

U.S. Pat. No. 3,596,842 discloses a similar device for the unpacking and separation of granulated substances packed in paper or similar material. The device consists of a funnel that conveys the packages to an isolating device, from which the packages fall as a result of gravity into the unpacking equipment. The unpacking equipment consists of several staggered rotating shafts on which toothed disks are arranged and whose rotational direction is determined. The packaging remnants and the unpacked granulate fall from the unpacking equipment onto a separation assembly arranged underneath. The separation assembly consists of an inclined electromechanically driven vibrating sieve, through which the granulate falls.

SUMMARY OF THE INVENTION

The invention therefore takes as its basis the task of specifying a bag opening and slitting device which, by technically simple means, constantly ensures a sure slitting open of the sacks (for example, coffee sacks), is easily handled, and is economical to manufacture.

This task is solved with a device of the kind mentioned at the beginning inventively by this, that in a housing at least one mechanically propelled shaft is arranged, on which in each case at least one cutting member is firmly mounted, and the housing has an inlet opening, through which the filled sacks can be brought either mechanically or by gravitational feed, and shows an outlet, through which the slit-open sacks and the goods released from the sacks can be led off by gravity, and that the housing has devices with which it can be attached to and detached from a transport container for sacks. Furthermore, the device comprises at least one moveable restraining apparatus fashioned in plate form with longitudinal slits, through which in a released state the at least one cutting member projects for optionally covering or releasing the at least one cutting member, wherein said restraining apparatus is movable by a drive assembly from a first position in which the restraining apparatus is in a covered state and prevents sacks from reaching the at least one cutting member to a second position in which the restraining apparatus is in a released state and allows sacks to reach the at least one cutting member.

By this restraining apparatus it is possible continually and directedly to convey the sacks to be cut to the cutting members.

By using at least two shafts, it is possible to slit open several sacks at the same time, so that the isolation of these sacks is omitted.

The number of sacks that can be slit open simultaneously can be increased by arranging three or four shafts next to each other, optionally allocated with regular distribution.

With this it is advantageous if, on each shaft, blades or disks are mounted with a regular or arbitrary distribution of the sort that the blades or disks of neighboring shafts are in a staggered arrangement. With this it is especially advantageous if the blades or disks have a rotation diameter that is greater than the distance of the shafts from each other. Especially for reasons of space, it can be advantageous to provide the blades or disks with different rotational diameters.

Although it is thoroughly conceivable according to the invention to arrange this device at the lower end of a slide or chute, which gravitationally conveys the emptied sacks to the device, it is especially advantageous so to fashion the invention-device on a housing can be fastened to and later detached from a transport container, which can be a truck with a bin attachment or a standard container for this, pins can be allocated at the four corners of the inlet opening, which engage with the latched openings present on the corners of the loading opening of the truck, container, or the standard container and can be made fast in them. In any case, for this a horizontal process of the device in the direction of the untitled container or standard container is necessary.

The attachment process can be made easier by having hooks on the upper two corners of the inlet opening, which can be hung in the upper two latched openings of the front side of the container or standard container, and by having pins on the lower two corners of the inlet opening, which engage the lower two latch openings and can be made fast with them.

For carrying out the process of slitting open, these transport containers or standard containers are tilted into an inclined state, for instance, by means of the tilting mechanism of the truck transporting the standard container.

In some cases it can occur that the sacks in the transport container can either be loaded wrongly or be thrown into disorder during transport and, in the process of tilting the transport container, form so-called sack-bridges, which prevent a further sliding of the sacks to the cutting apparatus. In a case of this sort, the inclination of the transport container must be sharply raised, so that the sack-bridge collapses. With this, however, the sacks can suddenly fall onto the blades or disks and brake these to a standstill. Also, the outflow of goods, for instance, coffee beans, and the cut open sacks is sometimes so disorderly that the equipment, which follows for the separation of sacks and goods, or for further processing, cannot process the intermittent accumulations of product.

The—for example—hydraulically operated restraining apparatus can take different processing positions for the exact measuring out of the cutting process and also can be regulated within these positions.

In order to ensure good operation with the minimal need for space of the restraining apparatus, it is advantageous that the rods or the plate(s) be so bent that, in the covered state of the restraining apparatus, the upper part of the rods or plate(s) extends over the rotation radius of the blades or the disks and the lower part of the rods or plates stands vertically and fully covers the conveyor opening(s) to the blades or disks.

In case the transport containers are loaded right up to their loading opening, it can occur that in the inclined state of this transport container, the once vertical state of the sacks, seen from the loading opening, is inclined almost as a compact wall, closed to the cutting apparatus, and through it no individual sacks can arrive at the blades. With this it is an advantage to arrange a horizontally running beam in the region of the inlet opening, which can also be located in the entrance opening or at the height of the lower shaft, in order to "break up" the wall of sacks.

This "breaking up" can be improved by arranging a moveable cutting apparatus at the height of the beam, which—for instance, by hydraulic operation—cuts open at least one of the sacks at the level of the beam.

So that the sacks cannot fall from above onto the blades or disks, it is advantageous to mount, in the inlet opening above the only or the uppermost shaft, an inclined deflector from the edge of the housing to the shaft.

The invention takes further as a basis the task of specifying a procedure for slitting open the sacks, for example, coffee sacks, which guarantees a simple, constantly secure, time-saving, and economical slitting open of the sacks.

According to the invention, this task is solved by this, that, at the loading opening of a transport container loaded with sacks, a device for the slitting of sacks is connected and subsequently the sacks are conveyed either mechanically or by gravity to this device.

In order to ensure the slitting of all sacks, a guiding assembly is recommended which is disposed opposite to the cutting edge of each cutting member of the lower shaft for feeding the sacks in the direction of the cutting member. It is favorable when the guiding assembly is formed as a plurality of narrow sheet metal elements which are bent in order to provide a guideway for the sacks. Each sheet metal element should correspond with a respective cutting edge of a cutting member.

The mechanical conveyance can be carried out advantageously by means of a sliding floor present in the transport container, while the desired or necessary gravitational effect is attainable by tilting the transport container, by which a truck carrying the transport container can even be driven onto a ramp or something similar. By this, for reasons already given, a restraining of the sacks by means of a restraining apparatus up to the desired or necessary inclination can be advantageous.

In operation a cutting device provided with a restraining apparatus is, for instance, mounted on a container or standard container to be emptied. The restraining apparatus is moved with hydraulics in the direction of the container and above all prevents the sacks from sliding into the cutting blades. Then the container is tilted to the desired or necessary angle. The sacks slide against the restraining apparatus, but not yet into the blades. Now the restraining apparatus is returned—Controlled, for example, by hydraulics. By this the cutting blades are free and the sacks can be slit open. By the placement of the restraining apparatus, the speed of the cutting process and thereby of the product flow can be regulated. By the high slanting position of the container, it is guaranteed that the sacks form no bridges and fully slide into the cutting blades. Moreover, the cutting process admits of being interrupted at any time with the restraining apparatus.

With this it is possible to cut open the filled sacks at any unloading site whatever and to convey the pile, consisting of cut sacks and the goods released from the sacks, to further processing.

Further characteristics and advantages of the invention result from the following description of an implementation form and the diagrams, to which reference is made.

DETAILED DESCRIPTION OF THE PREFERRED EMBODIMENTS

Figure 1A:
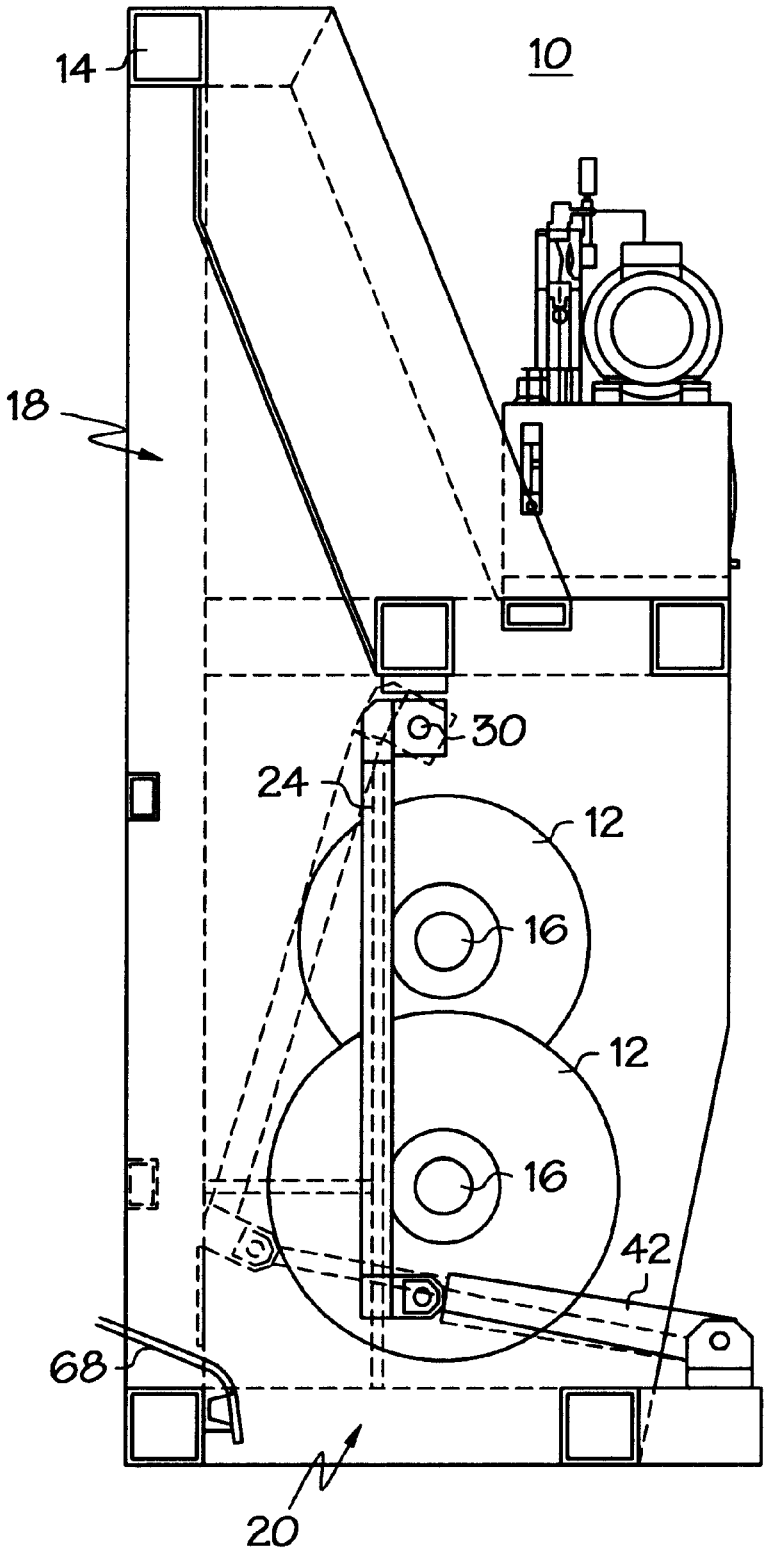
FIG. 1*a* is a partially cut-away side view of a device according to the present invention.

The device 10 according FIG. 1 has a housing 14 of essentially rectangular form, whose dimensions correspond to the front-side dimensions of a container 22 (FIGS. 6 through 9). The inlet opening 18 represented in FIG. 1 takes up the entire front side of this device 10. The region of the housing 14 lying opposite the inlet opening is designed as completely closed up to the corner region, at which a discharge opening 20 is present. This discharge opening 20 is so designed that lengthwise it replaces a cross edge of the housing 14.

Figure 10A:
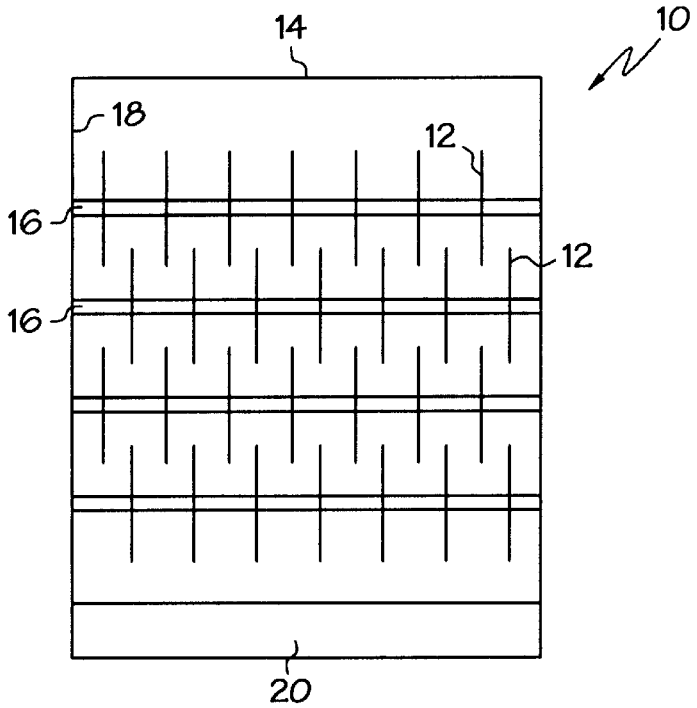
FIGS. 10*a* and 10*b* are schematic representations of devices for slitting open sacks, seen from the inlet opening.
Figure 10B:
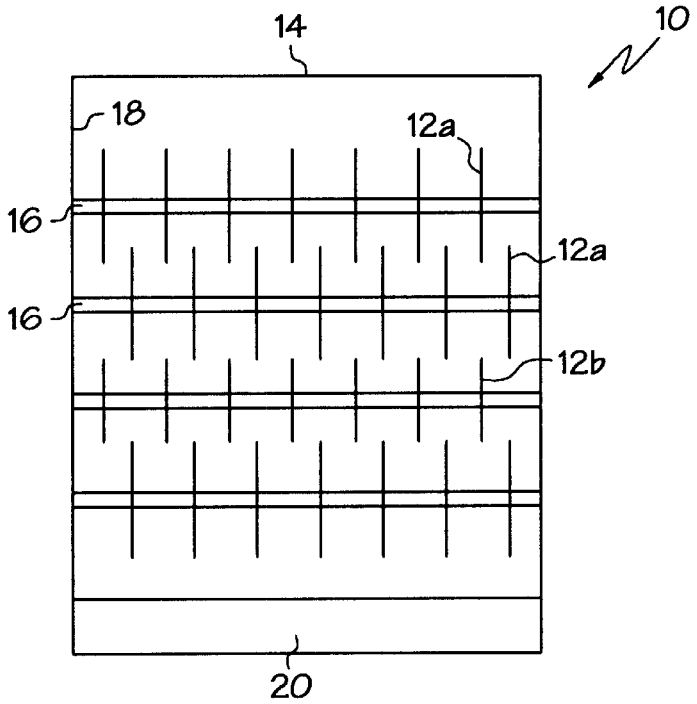

In the housing 14 of this embodiment, essentially parallel to the discharge opening 20, two shafts 16 are fastened with regular distribution parallel to each other and one over the other; with this their mechanical propulsion is not represented. Each shaft 16 carries several blades or disks 12, which are likewise arranged in regular distribution. With this the respective distribution of shafts 16 neighboring each other is so chosen that the respective blades or disks 12 on neighboring shafts are arranged as staggered. FIG. 10*a* is a schematic representation of another device for slitting open sacks in a front view. The device of this embodiment comprises four shafts 16 arranged parallel to each other. FIG. 10*b* is a schematic representation of another device for slitting open sacks in a front view. The device of this embodiment comprises four shafts 16 arranged parallel to each other with blades or disks 12*a* of a first diameter and blades or disks 12*b* of a second diameter smaller than the first diameter.

It is understood that other suitable cutting surfaces may also be used in addition to the blades and disks specifically mentioned herein. As such, the invention contemplates having at least one cutting member extending from each shaft for slitting open the sacks.

According to FIG. 1 a moveable restraining apparatus 24 fashioned in plate form with longitudinal slits is provided. The restraining apparatus 24 is movable by a hydraulic cylinder 42 from a first position in which the restraining apparatus is in a covered state and prevents sacks from reaching blades or disks 12 to the shown second position in which the restraining apparatus is in a released state and allows sacks to reach the blades or disks 12. The hydraulic cylinder 42 is disposed between the restraining apparatus 24 and the housing 14. The restraining apparatus 24 is slewable attached by hinges 30 to the housing 14 in order to slew the restraining apparatus 24 through the linear movement of the hydraulic cylinder 42.

Figure 1B:
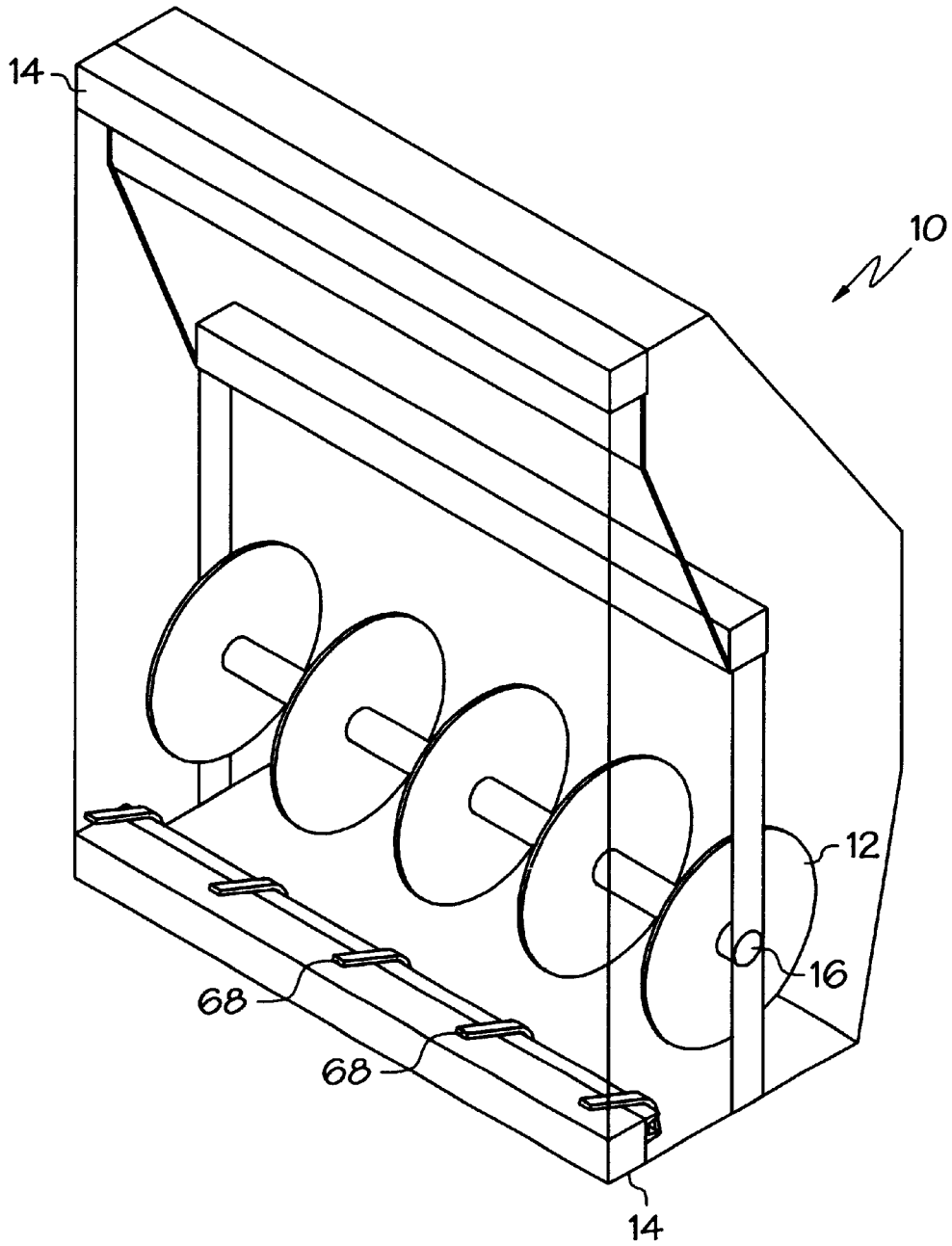
FIGS. 1*b* and 1*c* are perspective views with parts cut-away of devices according to the present invention.
Figure 1C:
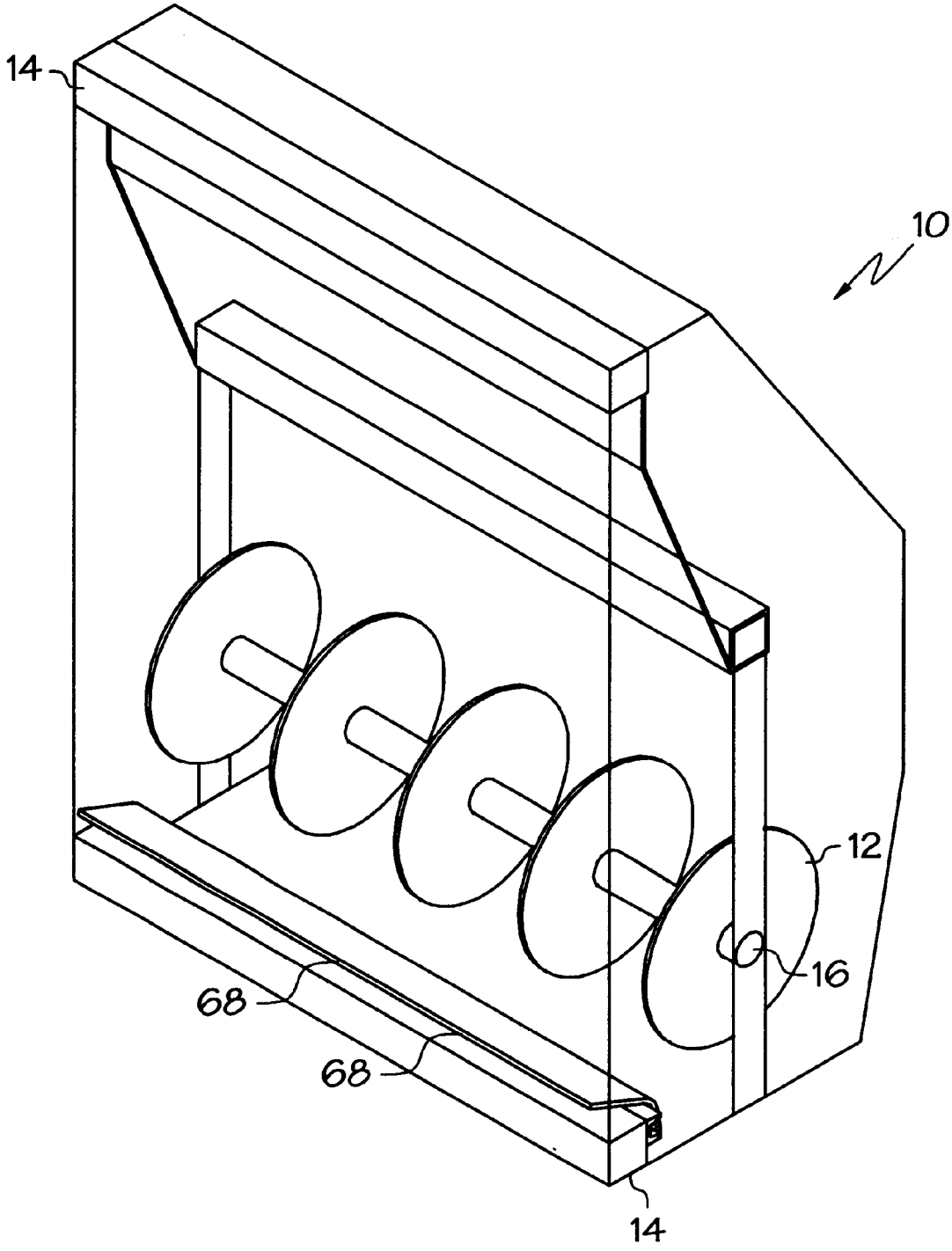

Furthermore, a guiding assembly 68 is provided which is disposed opposite to the cutting edge of the blades or disks 12 of the lower shaft 16 for feeding the sacks in the direction of the blades or disks 12 in order to ensure the slitting of these sacks which are located on the lower level of the device 10 next to the discharge opening 20. The distal end of the guiding assembly 68 which is formed as a plurality of bent narrow sheet metal elements corresponds with the bottom of the (not shown) container 22 in order to provide a guideway for the sacks. Each narrow sheet metal element corresponds to a respective cutting edge of a blade or disk 12 and is desirably substantially coplanar with the blade or disk. All narrow sheet metal elements of the guiding assembly 68 are attached to the housing 14 by screwing or welding or through any other suitable means. The guiding assembly may be seen in perspective in FIG. 1*b*. As shown in FIGS. 1*a* and 1*b*, guiding assembly 68 resembles a bent comb. In another embodiment of the invention, guiding assembly may be in the form of a continuous sheet, as shown in FIG. 1*c*. It is noted that in the embodiments of FIGS. 1*b* and 1*c*, only a single shaft is shown. Additional features including restraining apparatus 24 are omitted from FIGS. 1*b* and 1*c* for clarity. Guiding assembly 68 may be provided in any of the embodiments disclosed herein.

Guiding assembly 68, by guiding limp sacks closer to the blades or disks, proves particularly useful in preventing limp sacks from slipping past the blades or disks without being cut. Limps sacks are sacks which are partially empty—for example a sack with holes through which some of the contents of the sack have spilled. Desirably, guiding assembly 68 will be configured such that sacks having as little as ½ of the contents of a filled sack or less will be slit.

Figure 2:
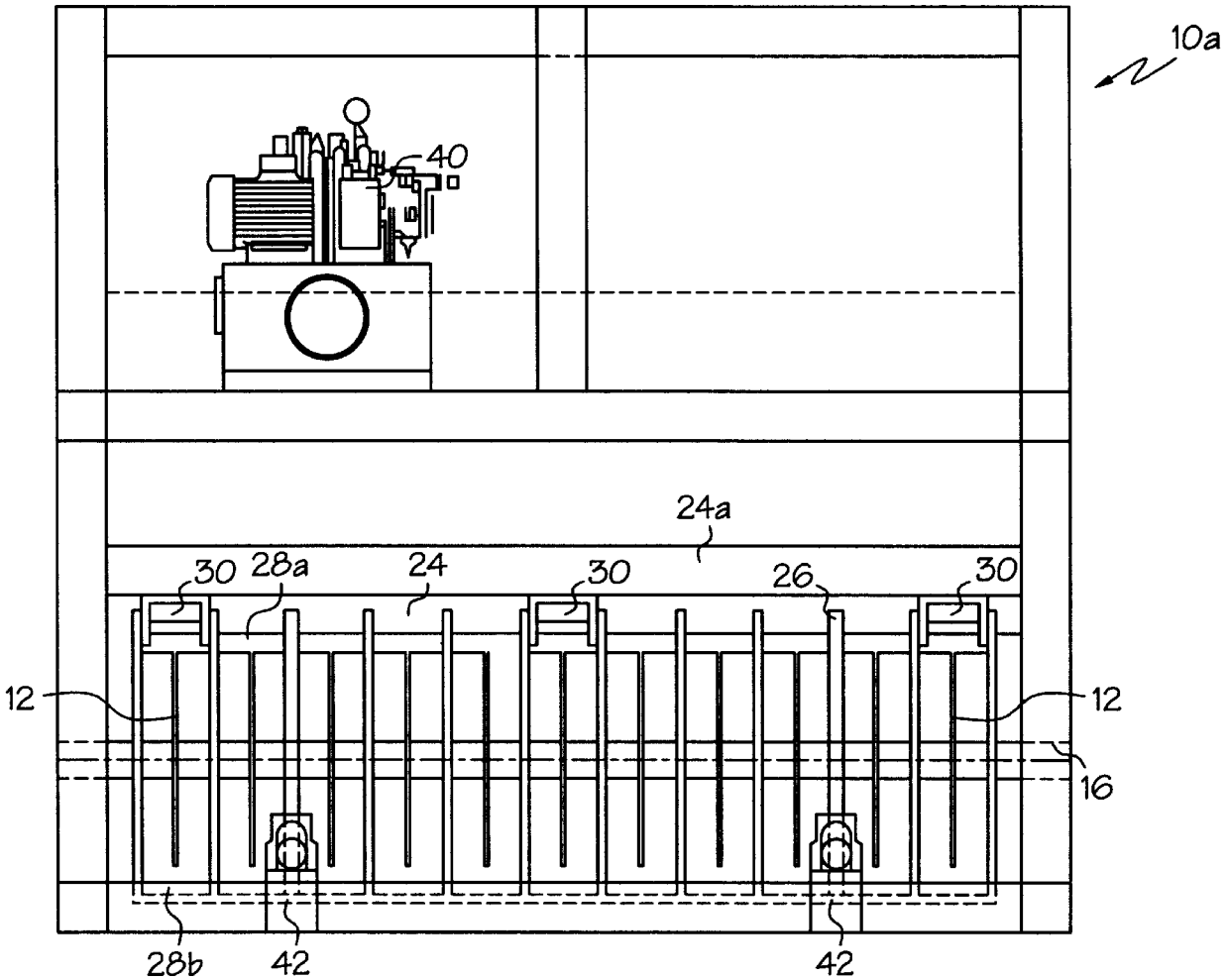
FIG. 2 is a schematic representation of the device for slitting open sacks, seen from the discharge opening, according to a further plan of implementation.
Figure 3:
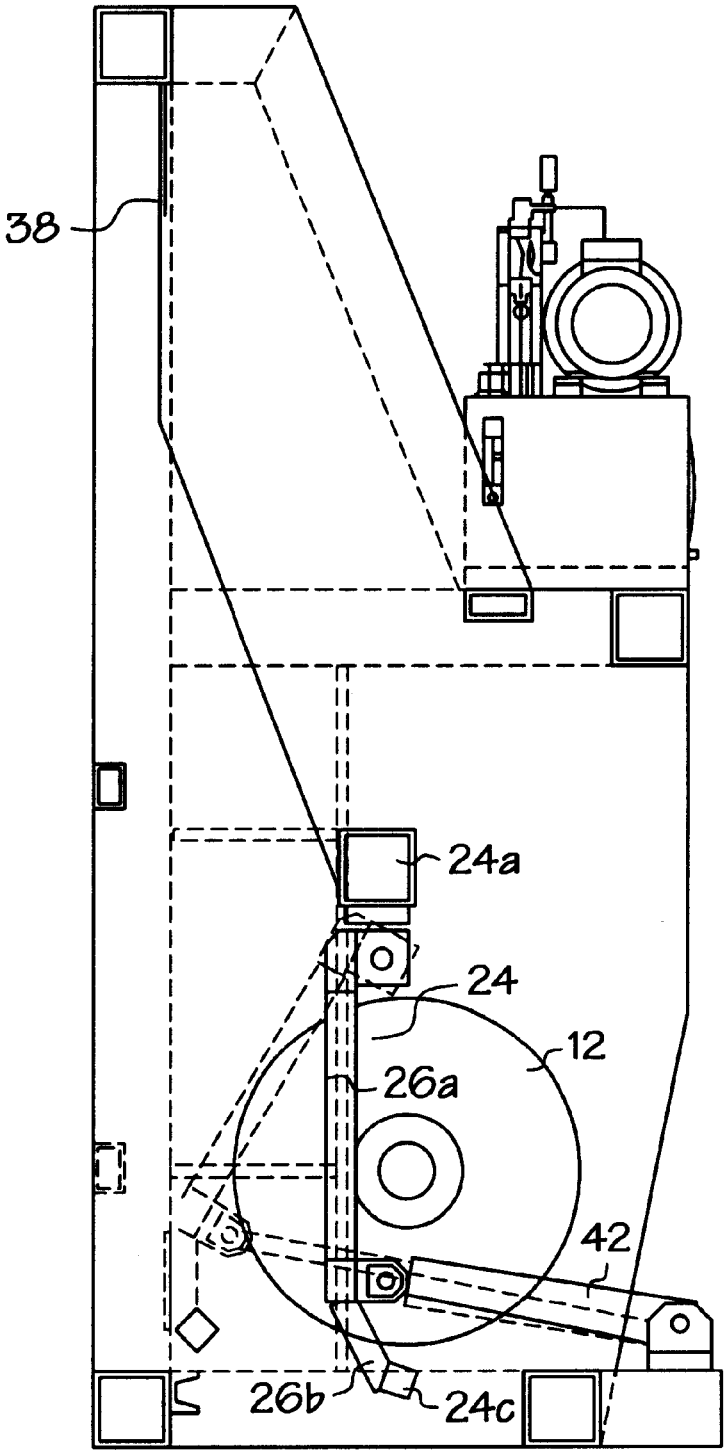
FIG. 3 is a partially cut-away side view of the device according to FIG. 6.

The design form of the device 10*a* for slitting open sacks, shown in FIG. 2 or FIG. 3, is distinguished from that represented in FIG. 1 essentially by this, that in the inlet opening of the—in this case—one shaft 16, a lattice-shaped restraining apparatus 24 is arranged to be pivoted.

Above the shaft 16 the restraining apparatus 24 with three hinges 30 is attached to a four-edged cross member 24*a*. With a hydraulic unit 40, the restraining apparatus 24 can be moved forward and backward. The restraining lattice 24 consists in this ease of vertical rods 26, which are fastened to a cross-beam above. At the bottom ends, the vertical rods 26 are fastened for reasons of stability to a further cross-beam 28*b*. The vertical rods are in their lengths so squared off that, with the restraining or covering position represented with hash-marks in FIG. 3, the upper part 26*a* of the rods 26 extends over the rotation radius of the blades or disks 12, while the lower part 26*b* stands vertically and fully covers the conveyor opening to the blades or disks 12.

The restraining apparatus 24 can be moved by two hydraulic cylinders 42, which touch approximately at the transition area from the upper part 26*a* to the lower part 26*b* of the rods 26. This movement or operation of the restraining apparatus 24 can be regulated and carried out with the help of a control module, which is not represented.

In the inlet opening 18 above the shaft 16, a deflector 38, going out from the upper edge of the housing, is attached, which first runs vertically and then is inclined to 5 the shaft 16. This deflector prevents a vertical striking of the sacks upon the blades or disks 12.

The apparatus, including the housing, inlet opening, shafts, rotating blades or cutting disks, deflector and discharge opening are all desirably constructed and arranged so as to allow a filled sack such as a coffee sack to pass there through. Desirably, the filled coffee sacks will be approximately 1 m long, 60 cm in breadth and 40 cm in width, however, the apparatus may be configured to accommodate smaller or larger sacks.

Figure 4:
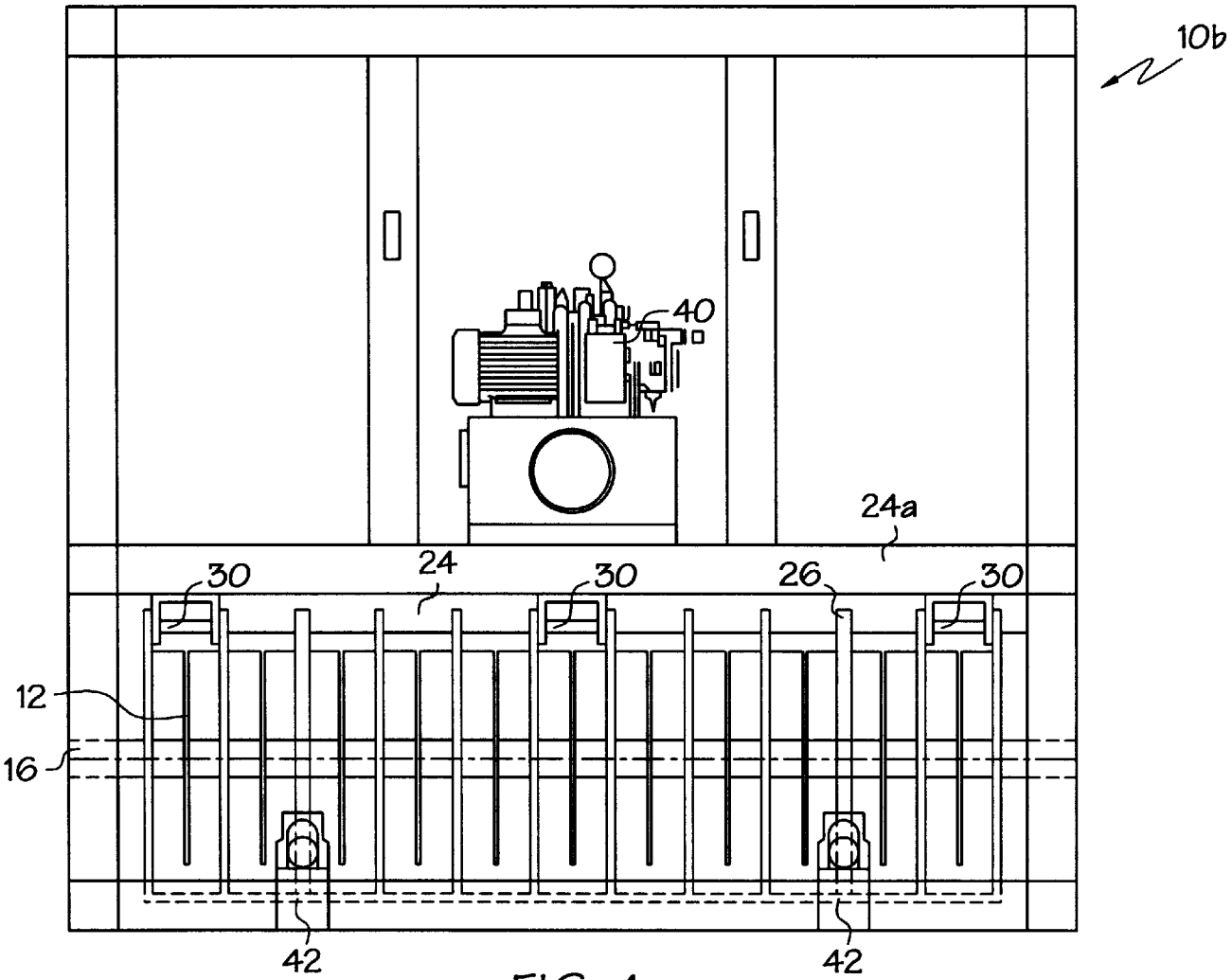
FIG. 4 is a schematic representation of the device for slitting open sacks, seen from the discharge opening, according to a third plan of implementation.
Figure 5:
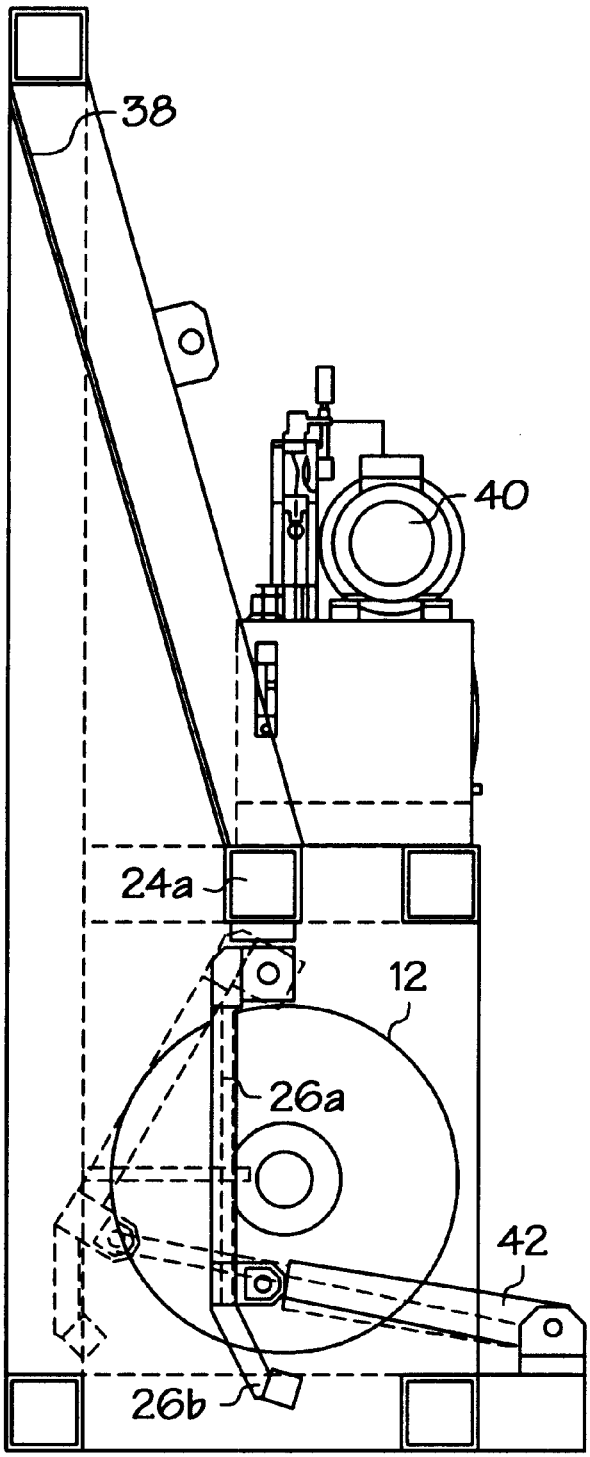
FIG. 5 is a partially cut-away side view of the device according to FIG. 8.

The design forms shown in FIGS. 4 and 5 are distinguished from those in FIGS. 2 and 3 essentially in this, that the deflector 38 is inclined directly from the upper, housing edge in the direction of the shaft 16. Furthermore, the hydraulic unit 40 occupies another position compared with the previously described design form, and is now at this stage set approximately in the middle of the device 10*b*. All other characteristics of this device 10*b* agree with the device 10*a* of FIGS. 2 and 3 and therefore have the same reference numbers.

Both devices 10*a* and 10*b* are designed for this, to be mounted on a transport container to be emptied, for example the opening for loading of a container, especially a standard container 22, for carrying out the specified form of the procedure for slitting open sacks. The restraining apparatus 24 is moved with the hydraulic unit 40 in the direction of the transport container and thus, first of all, prevents the sacks from being able to slide into the blades 12. Then the transport container is tilted to the maximum slope. The sacks slide against the restraining apparatus 24, but not yet into the blades 12.

Subsequently the restraining apparatus 24 is brought back in a controlled manner with the help of the hydraulic unit 40. By this the blades 13 become free and the sacks can be cut open. By the controllable position of the restraining apparatus 24, the speed of the cutting process and thereby the product flow can be regulated.

Figure 6:
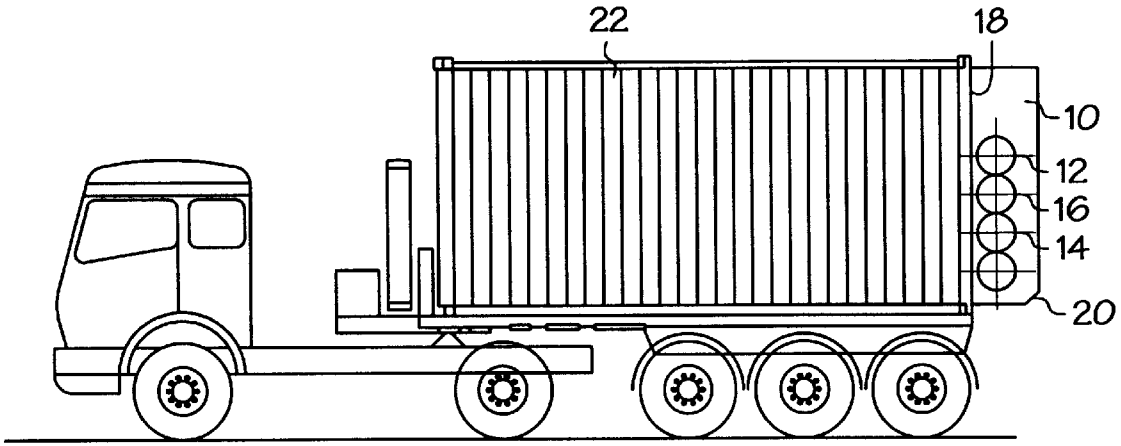
FIGS. 6 and 7 are, side views of trucks carrying standard containers with an attached device for slitting open sacks attached to one end of the standard container.
Figure 7:
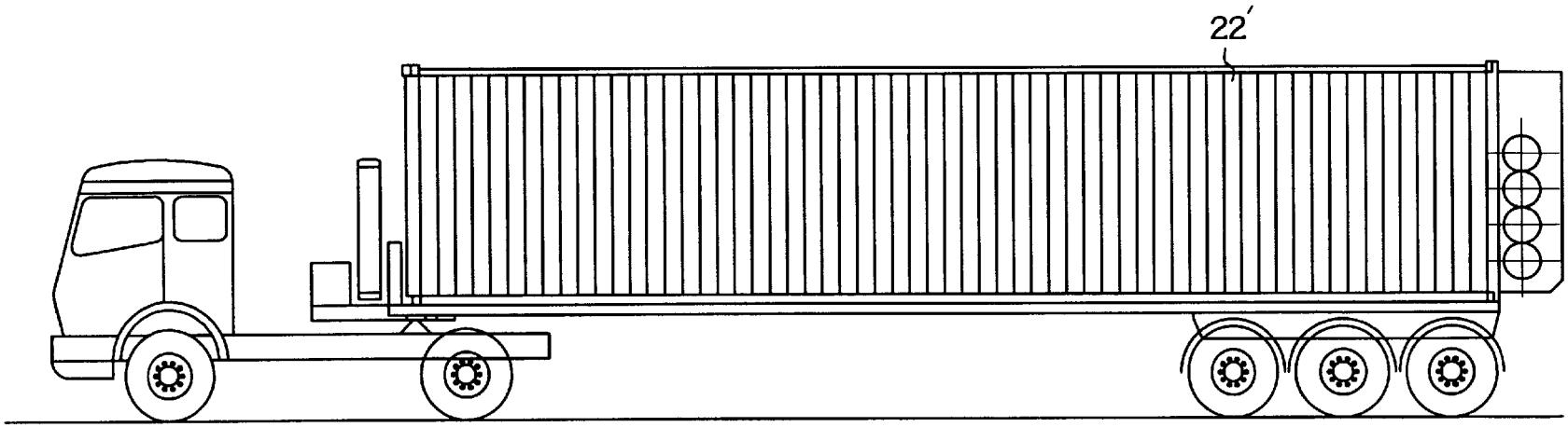

In FIGS. 6 and 7, the respective trucks are represented in side view, each of which carries a standard container 22; whereas the standard container 22' represented in FIG. 7 is only twice as long as the standard container 22 represented in FIG. 6. To the respective front side, turned away from the truck cabin, of the standard container 22, the device 10 according to FIG. 1 for the slitting open of sacks or coffee sacks is mounted, for example by flange-mounting, so that this device 10 can at any time be taken off again. Of course, the devices 10*a* and 10*b* of FIGS. 2 through 5 can also be attached to the standard container 22.

Figure 8:
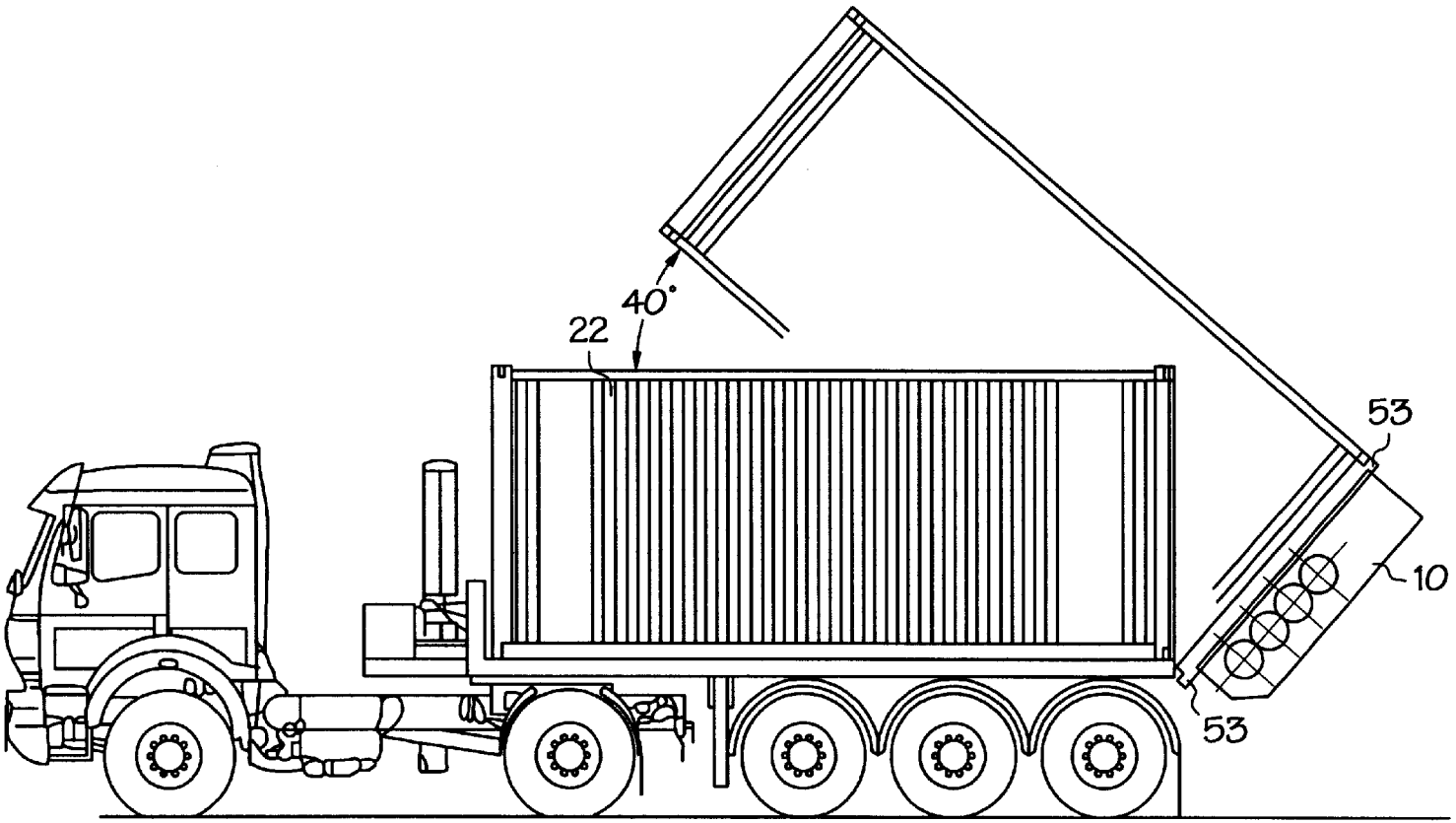
FIGS. 8 and 9 are side views of the trucks of FIGS. 2 and 3, with which the standard container is brought in each case into a tilted position.
Figure 9:
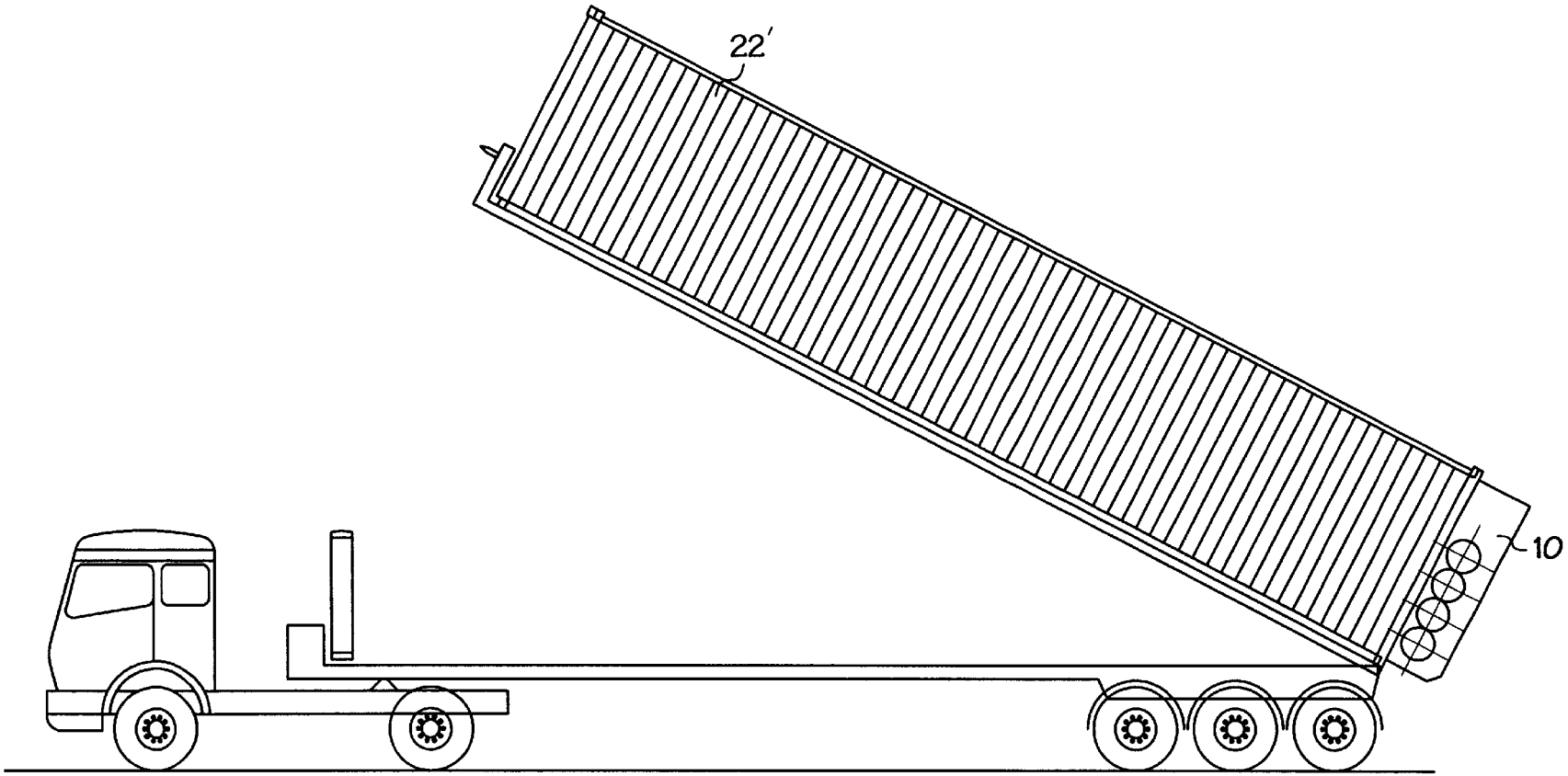

In FIGS. 8 and 9, the side views of the truck are represented as in FIGS. 6 and 7, of course with the tilted state of the standard container 22, 22' that is necessary for the operation of the devices 10. This tipped state is necessary in order to ensure the moving of the sacks under gravity to the device 10.

If the standard containers 22 or 22', have taken up the tilted states represented in FIGS. 8 and 9, the shafts 16 and with them also the blades or disks 12 of the device are shifted in rotation, so that the sacks lying directly at the device 10 are not only slit open, but are also advanced to the wall lying against the inlet opening 18. Because of gravity, the pile of cut open sacks and goods released from the sacks, for example, cut-open coffee sacks and coffee-beans, slides in the direction of the discharge opening and by this leaves the device 10.

Figure 11B:
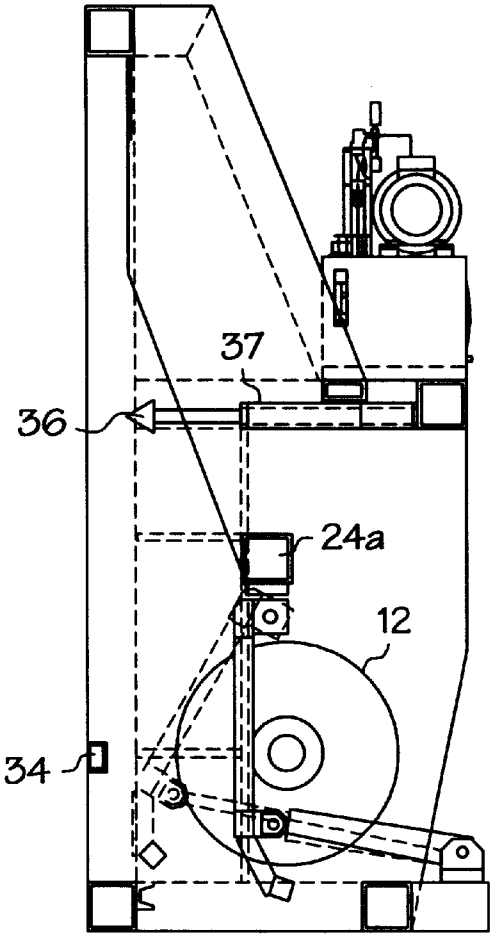
FIGS. 11*a* and 11*b* show the device with a horizontal running beam and a 20 moveable cutter.
Figure 11A:
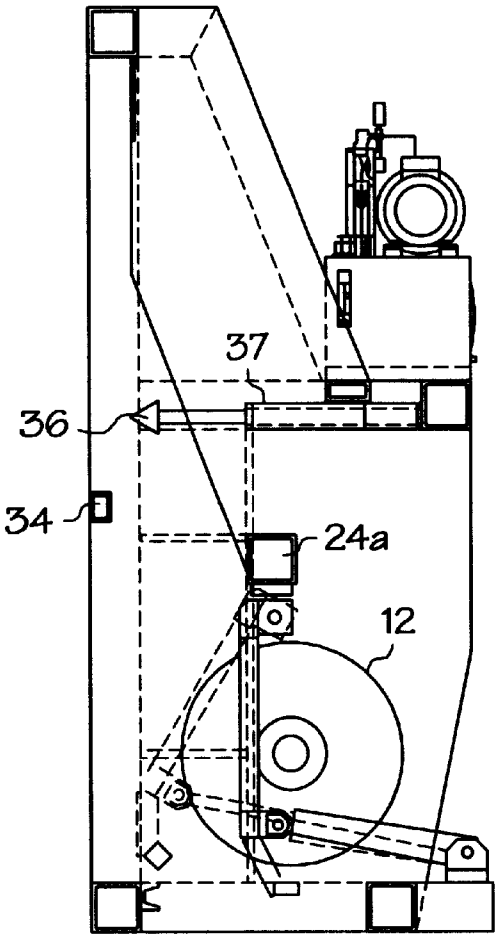

The device may further include a horizontally running beam 34 in the region of the inlet opening, as shown in FIG. 11*a,* which can also be located elsewhere in the entrance opening or at the height of the lower shaft, as shown in FIG. 11*b,* in order to "break up" any wall of sacks that may form.

This "breaking up" can be improved by arranging a moveable cutting apparatus 36 at the height of the beam, which—for instance, by a hydraulic device 37—cuts open at least one of the sacks at the level of the beam, or above or below the level of the beam. Cutting apparatus 36 may consist of a single cutting implement extending along the length of the inlet opening or may consist of several adjacent cutting implements arranged side-by-side along the length of the inlet opening. Desirably, cutting apparatus 36 will include a sharp blade for cutting sacks. Those of ordinary skill in the art will recognize that cutting implements with other shapes and configurations may be used as well for cutting sacks in the region of the horizontally running beam.

Figure 12:
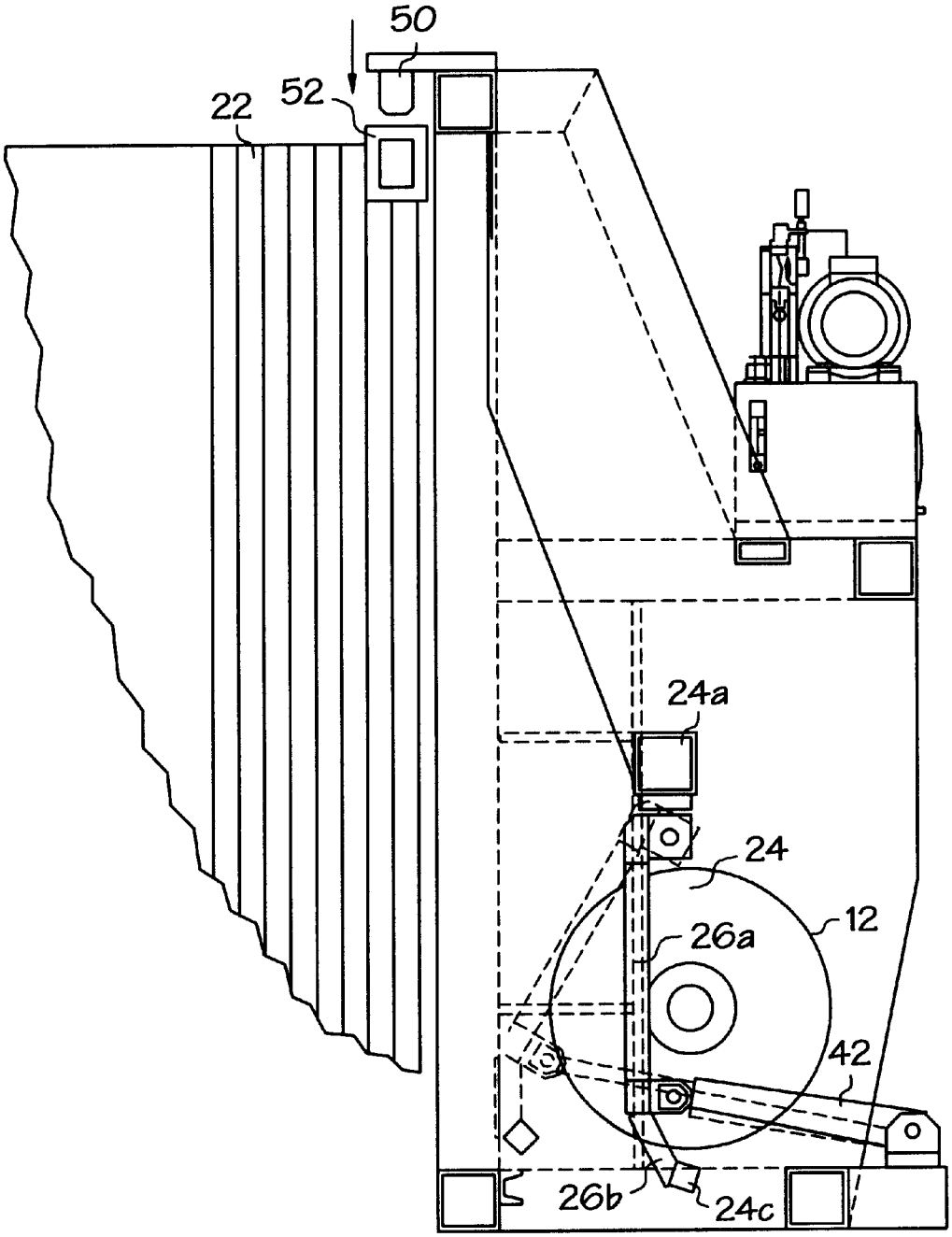
FIG. 12 is a partially cut-away side view of the device according to FIG. 6 showing pins and latches.

The attachment process can be made easier by having pins 50 on the upper two 30 corners of the inlet opening, as shown in FIG. 12 which can be hung in the upper two latched openings 52 of the front side of the container or standard container.

Figure 13:
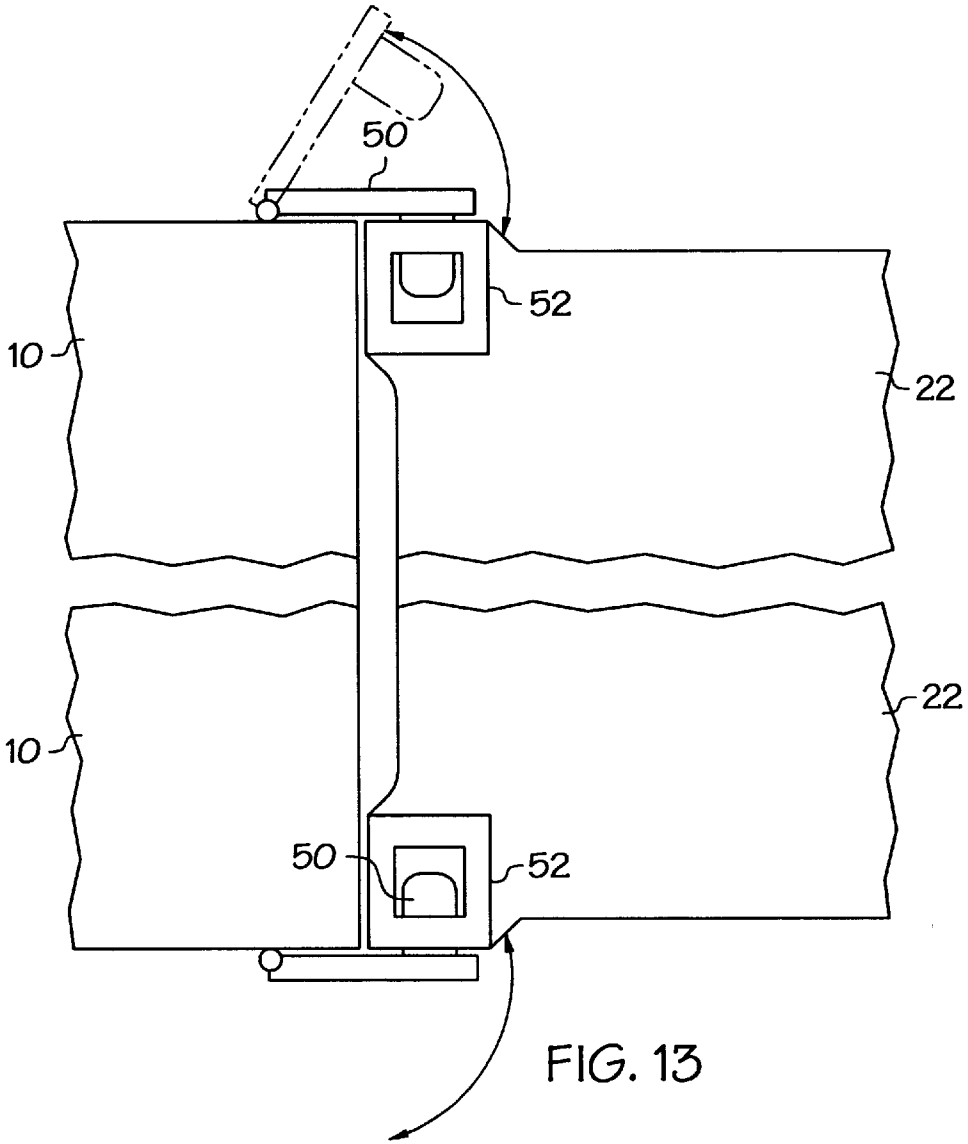
FIG. 13 shows a bottom plan view of pins engaging latch openings on the bottom of a transport container.

The device may further have pins on the lower two corners of the inlet opening, which engage the lower two latch openings and can be made fast with them. FIG. 13 shows pins 50 extending from device 10 at the bottom corners of the inlet opening. Pins 50 are shown engaging latched openings 52 in the bottom of container 22. Pins 50 swing inward through an opening in the container to engage latched openings 52. The invention also contemplates pins which swing upward to engage latched openings.

Figure 14:
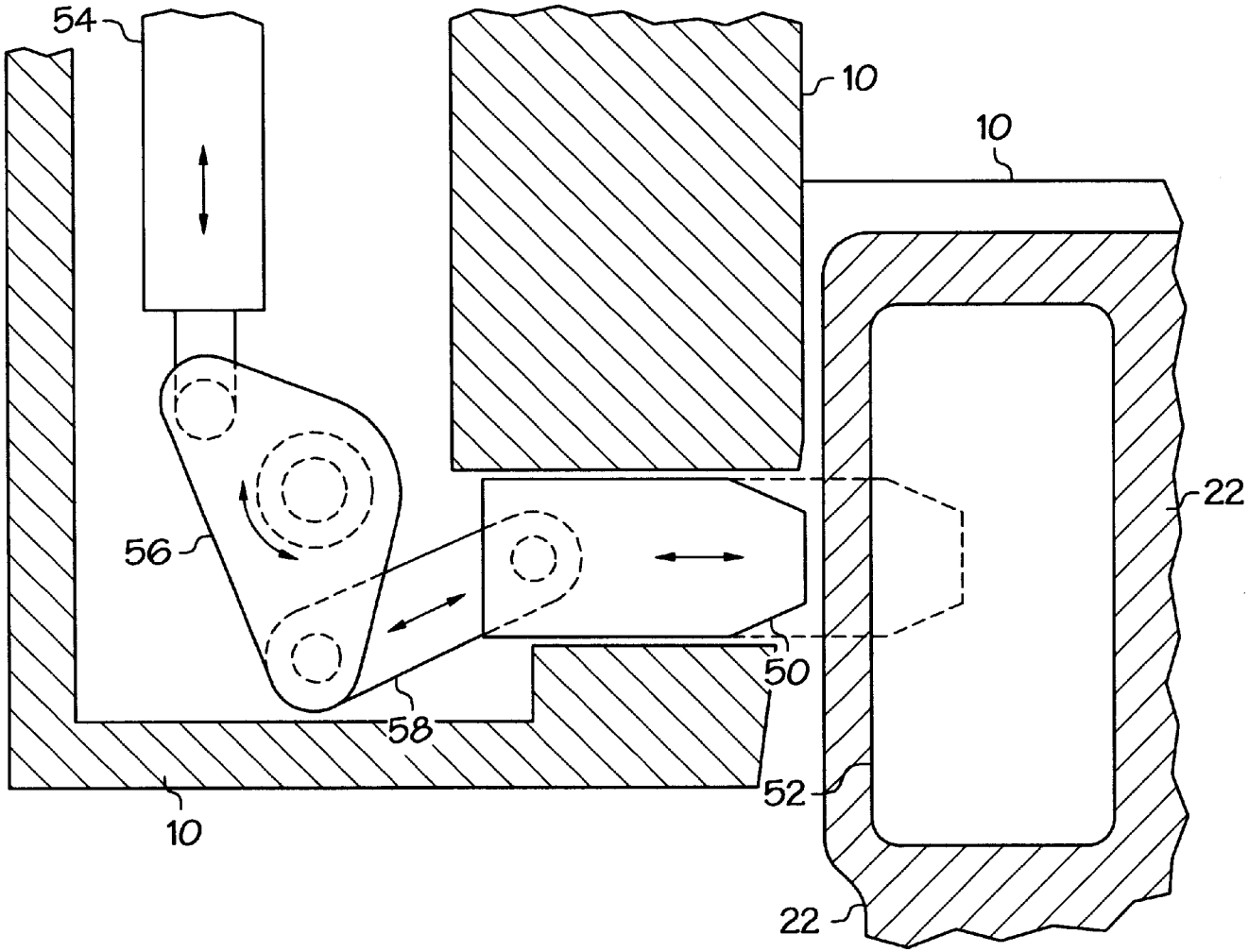
FIG. 14 shows a bottom plan view of hydraulically driven pins engaging latch openings on the bottom of a transport container.

As shown in FIG. 14, pins 50 may also be driven hydraulically. Hydraulic cylinder 54 is connected to pivotally mounted bell crank 56 which, in turn, is attached to swing link 58. Swing link 58 is connected to latch pall 60. Bell crank 56 together with swing link 58 translate the motion of the hydraulic cylinder in one direction to motion of the latch pall in a perpendicular direction. Upon activation of hydraulic cylinder 54, latch pall 60 engages latched opening 52 and serves as a pin to hold the apparatus in place.

The invention also contemplates the use of hydraulic cylinders without the bell crank to drive the pins.

The pins shown in FIGS. 12–14 are understood to be exemplary. Other arrangements and configurations of pins may be used as well. Hooks 53 shown in FIG. 8 may also be used.

This mass being poured out is separated in the well-known manner and after the separation process, the slit-open sacks can be disposed of or recycled in the usual way. The coffee beans are likewise conveyed to further processing.

With this device for slitting open sacks, not only are the well-known personnel and maintenance costs necessary for the operation of the slitting-open installation avoided, but it is also possible, because of the simple transportability of this device, to set it up at any desired place.

What is claimed is as follows:

1. A device (10) for slitting-open filled sacks comprsing:

a housing (14) having a frontside, a backside and two connecting sides extending between the frontside and the backside;

an inlet opening (18) in the frontside;

the backside having a discharge opening (20) therein through which slit-open sacks and the goods released from the sacks can be carried off;

at least one mechanically driven shaft (16), the shaft rotatably installed in the housing between the inlet opening and the backside;

at least one cutting member mounted on each shaft for slitting open the sacks, wherein the inlet opening is sized such that filled sacks can be conveyed there through to the at least one cutting member;

at least one moveable restraining apparatus (24) having longitudinal slits, through which in a released state the at least one cutting member projects for covering or releasing the at least one cutting member, said at least one restraining apparatus (24) movable by a drive assembly from a first position in which the at least one restraining apparatus is in a covered state and prevents sacks from reaching the at least one cutting member to a second position in which the at least one restraining apparatus is in a released state and allows sacks to reach the at least one cutting member.

2. The device of claim 1 wherein the drive assembly is a hydraulic cylinder (42) which is disposed between the at least one restraining apparatus (24) and the housing (14), and the at least one restraining apparatus (24) is attached by hinges (30) slewable to the housing (14) in order to slew the at least one restraining apparatus (24) through the linear movement of the hydraulic cylinder (42).

3. The device of claim 1 wherein the at least one restraining apparatus (24) consists of vertically arranged rods (26) having ends, said ends being attached to cross beams (28*a,* 28*b*), said ends being constructed and arranged that in the released state of the at least one restraining apparatus (24) the rods are located proximate to the at least one cutting member.

4. The device of claim 3 wherein the at least one cutting member is formed as a blade or a disk (12).

5. The device of claim 4 wherein the rods (26) are squared off such that in the covered state of the at least one restraining apparatus (24) an upper part **(26*a*) of the rods (26) extends over the blades or disks (12) and a lower part (26*b*) of the rods (26) stands vertically and fully covers the conveyor opening to the blades or the disks (12)**.

6. The device of claim 4 the at least one shaft comprising a plurality of shafts, said plurality of shafts being positioned adjacent to each other, and on each shaft (16) the blade or disk (12) is attached in a manner so that the positioning of the blades or disks (12) on adjacent shafts are staggered.

7. The device of claim 6 wherein the blades or disks (12) on adjacent shafts have different rotational diameters.

8. The device of claim 1 further comprising hinges (30) wherein the at least one restraining apparatus (24) is attached by the hinges (30) to a cross member arranged above the at least one shaft (16) on the housing (14).

9. The device of claim 1 comprising a plurality of restraining apparatuses, each restraining apparatus attached by hinges (30) to a cross member arranged above the at least one shaft (16).

10. The device of claim 1 wherein the at least one restraining apparatus (24) is constructed and arranged to assume different processing positions relative to the at least one cutting member.

11. The device of claim 1 wherein in the area of the inlet opening (18) a horizontally running beam (34) is arranged.

12. The device of claim 11 wherein the beam (34) is arranged in approximately the middle of the inlet opening.

13. The device of claim 11 wherein the beam (34) is arranged at the height of the at least one shaft (16).

14. The device of claim 11 having a movable cutting device (36) disposed at the level of the beam (34).

15. The device of claim 14 wherein the cutting device (36) is operated hydraulically.

16. The device of claim 1 having a deflector (38), said deflector being disposed in the inlet opening (18) above the at least one shaft (16) said deflector being inclined from an edge of the housing to the at lease one shaft (16).

17. The device of claim 1, the at least one shaft comprising 2 to 4 shafts (16).

18. The device of claim 1 mounted on a transport container (22), the inlet opening (18) corresponding to the dimensions of a front side of the transport container (22).

19. The device of claim 18 having corners with pins thereon, the device mounted to the transport container (22) via pins on the corners, the pins attached to latched openings present on the corners of the front side of the transport container (22).

20. The device of claim 19 wherein at least some of the pins are hydraulically actuated.

21. The device of claim 1 said at least one shaft comprising a plurality of mechanically driven shafts, each shaft (16) rotatably installed in the housing (14) between the inlet opening (18) and the backside.

22. The device of claim 1, wherein a guiding assembly (68) is provided which is disposed opposite to a cutting edge of the at least one cutting member of the at least one shaft (16) for feeding the sacks in the direction of the cutting member in order to ensure the slitting of the sacks.

23. The device of claim 22 wherein the guiding assembly (68) is formed as a plurality of narrow sheet metal elements which are bent in order to provide a guideway for the sacks.

24. The device of claim 23 wherein each sheet metal element corresponds with a respective cutting edge of a cutting member.

25. The device of claim 22 wherein the guiding assembly (68) is attached to the housing (14).

* * * * *

UNITED STATES PATENT AND TRADEMARK OFFICE

CERTIFICATE OF CORRECTION

PATENT NO. : 6,457,930 B2
DATED : October 1, 2002
INVENTOR(S) : Hermsen et al.

It is certified that error appears in the above-identified patent and that said Letters Patent is hereby corrected as shown below:

Title page,
Item [63], change "Continuation-in-part of application No. 09/264,798, filed on Mar. 9, 1999, now abandoned, which is a continuation-in-part of application No. 08/703,668, filed on Aug. 27, 1996, now abandoned, which is a continuation of application No. PCT/EP95/00698, filed on Feb. 27, 1998."
to
-- Item [63], Continuation-in-part of application No. 09/264,798, filed on Mar. 9, 1999, now abandoned, which is a continuation-in-part of application No. 08/703,668, filed on Aug. 27, 1996, now abandoned, which is a continuation of application No. PCT/EP95/00698, filed on Feb. 27, 1995. --

Signed and Sealed this

Twentieth Day of May, 2003

JAMES E. ROGAN
*Director of the United States Patent and Trademark Office*